United States Patent [19]

Williams

[11] Patent Number: 4,919,218

[45] Date of Patent: Apr. 24, 1990

[54] PROCESS FOR REESTABLISHING CIRCULATION IN A LOST RETURN ZONE

[76] Inventor: James M. Williams, 404 Academy St., Houma, La. 70360

[21] Appl. No.: 301,624

[22] Filed: Jan. 25, 1989

[51] Int. Cl.[5] ..... E21B 7/00

[52] U.S. Cl. ..... 175/72; 166/273

[58] Field of Search ..... 175/72, 57, 65; 166/273, 274, 275

[56] References Cited

U.S. PATENT DOCUMENTS

| | | | |
|---|---|---|---|
| 2,747,839 | 5/1956 | Moore | 175/72 |
| 4,116,285 | 9/1978 | Guerber | 175/72 |
| 4,282,928 | 8/1981 | McDonald et al. | 175/72 |
| 4,310,058 | 1/1982 | Bourgoyne, Jr. | 175/65 |

*Primary Examiner*—Jerome W. Massie
*Assistant Examiner*—Terry Lee Melius
*Attorney, Agent, or Firm*—Pravel, Gambrell, Hewitt, Kimball & Krieger

[57] ABSTRACT

In a process of downhole drilling in an open hole, where the drill bit has struck a lost circulation zone in the wall of the formation, and mud circulating through the annulus during drilling has been lost into the zone and therefore circulation of the mud has been lost, the process for reestablishing circulation downhole would include the steps of (b) closing off any flow of mud out of the annulus substantially at the level of the earth's surface; (a) introducing a quantity of lighter fluids such as salt water into the annulus so that the annulus becomes filled with the lighter fluid; (c) pushing a quantity of the mud in the annulus into the formation by the weight of the lighter fluid in the annulus, thus lowering the weight of the column of fluid in the annulus; (d) in calculating the mud weight necessary to circulate out the heavy mud with the lighter fluid; and introducing the lighter weight mud into the hole and into the drill pipe, for allowing the heavier mud to circulate up through the annulus to be replaced by the lighter mud.

10 Claims, 3 Drawing Sheets

PROCESS FOR REESTABLISHING CIRCULATION IN A LOST RETURN ZONE

BACKGROUND OF THE INVENTION

1. Field of the Invention

The present invention relates to oil well drilling. More particularly, the present invention relates to a process for regaining circulation of mud downhole during the drilling process after a quantity of the mud within the annulus has been lost into the strata in a "lost circulation zone".

2. General Background

In the drilling of oil wells, the manner in which the drill bit is maintained relatively cool, and the cuttings from the bit are returned to the surface is very important. In the present state of the art, as the bit is drilling through the strata downhole, a particular weight mud, either water base or oil base, is circulated down through the drill string through the drill bit, wherein the mud picks up the cuttings from the bit, and is recirculated back to the surface in the annular space between the outer wall of the drill string and the wall of the formation that the bit is drilling through. The column of mud, in accomplishing this constant circulation down through the string and up through the annulus, also serves to protect against the inadvertent striking of a pocket of pressurized hydrocarbons, and to maintain the hydrostatic head on the formation so that the well would not blow out in the event that such a pocket were struck by the drill bit.

However, one problem which is confronted in open hole drilling, is the fact that sometimes the drill bit will run through a zone of formation which is called a "no circulation zone", where the wall of the formation would collapse, and allow the mud in the annulus to flow into the formation, and into the lost circulation zone. Through experience, it has been found when such lost circulation occurs, there are few remedies that can be achieved in order to regain circulation. If, for example, one knows of the depth of the lost circulation zone, it may be possible to send materials down the annulus to that particular depth, in order to "plug" the hole in the formation, and maintain the drilling process. Otherwise, often times it is necessary that this particular wall of the annulus has to be cemented so as to provide the necessary wall that will not allow further loss of mud so that recirculation of the mud can be obtained. However, if one is unable to determine the depth of the lost circulation zone, or if the lost circulation zone is such of a magnitude that one is unable to "plug it", then there is virtually no way that recirculation of the mud can be obtained, and often times the hole must simply be abandoned and redrilled elsewhere.

Therefore, one must address the need for a manner in which recirculation of the mud in the annulus during drilling can be gained following the striking of a lost circulation zone by the bit, and the loss of mud into the formation.

SUMMARY OF THE PRESENT INVENTION

In a process of downhole drilling in an open hole, where the drill bit has struck a lost circulation zone in the wall of the formation, and mud circulating through the annulus during drilling has been lost into the zone and therefore circulation of the mud has been lost, the process for establishing circulation downhole and includes the steps of (a) detecting a drop in the mud level within the annulus of the drill casing to a certain depth; (b) introducing a quantity of lighter fluid such as salt water into the annulus so that the annulus becomes filled with the lighter fluid; (c) closing off any flow of mud out of the annulus substantially at the level of the earth's surface (by closing the "hydril"; (d) flowing additional quantity of the lighter fluid into the annulus to push a quantity of the mud in the annulus into the formation, thus lowering the weight of the column of fluid in the annulus; (e) calculating the mud weight necessary to recirculate out the heavy mud with the lighter fluid; and (f) introducing a quantity of lighter weight mud into the bore hole and into the drill pipe, for allowing the heavier mud to circulate after the annulus is replaced by the lighter mud so that recirculation can be established.

Therefore, it is a principal object of the present invention to provide a process whereby recirculation of mud in a bore hole can be regained after entering a lost return zone;

It is still a further object of the present invention to provide a process for finding the necessary weight of lighter fluid to be introduced into the bore hole where there has been lost circulation, so that heavier mud can be replaced by a lighter mud and recirculation can be obtained; and It is still a further object of the present invention to provide a process for regaining circulation after mud has been lost in the lost return zone downhole, by closing off the hydril, and introducing a lighter fluid so that the heavier mud is pushed into the formation, and the necessary weight mud, is calculated, introduced downhole, and allows recirculation to be obtained.

These and other objects of this invention will be readily apparent to those skilled in the art from the detailed description and claims which follow.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
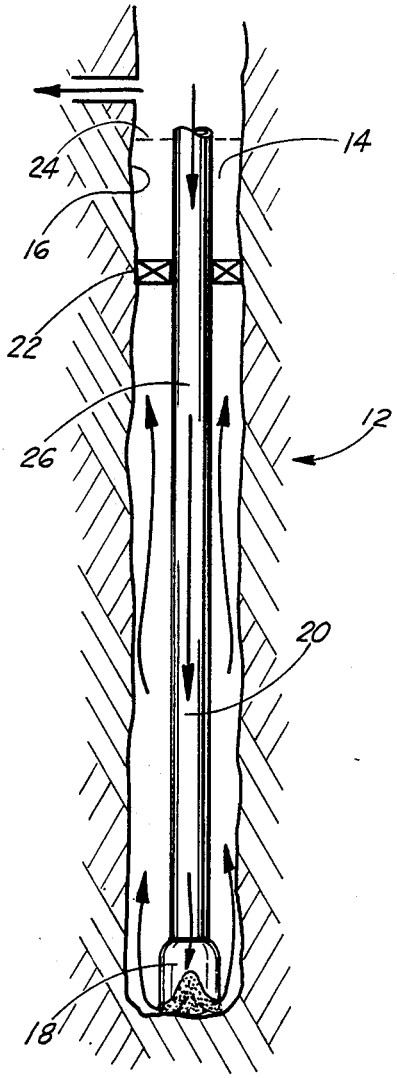
FIG. 1 illustrates a cross-section of a typical open borehole that is being drilled via a drill bit at the end of a drill string.

As illustrated in the FIGS., the process of the present invention would relate to typical borehole as illustrated in FIG. 1, wherein there is included a borehole 12, having a diameter 14, the borehole 12 being a "open hole", that is where casing is no longer lining the walls 16 of the borehole 12, and the only support for the walls 16 of the borehole 12 is the formation itself. In this particular drilling process, a borehole at this depth is being drilled by a drill bit 18, at the end of a drill string 20, which emanates from the ground above. As illustrated in FIG. 1, there is further included an apparatus for closing off the flow of fluid from the borehole, this apparatus known in the art as a hydril 22, as seen in FIG. 1. In FIG. 1, in the normal process, a column of mud 24 is contained within the borehole, in a dynamic state, in order to provide a hydrostatic head against the formation and the point of the drill bit, so as to prevent any advertent blowout should the bit strike a pocket of hydrocarbons. The weight of the mud is usually calculated so as to provide the necessary hydrostatic head, yet allow circulation of the mud down through the internal bore 26 of the drill string in order to lubricate the bit, and up to the annulus between the wall of the borehole and the outer wall of the drill string in order to return the cuttings made by the bit up to the surface that can be filtered out so that mud can be returned down the hole. As was stated earlier, this circulation of mud through the borehole during drilling is a dynamic system, and is a very well balanced system in terms of weight.

Figure 2:
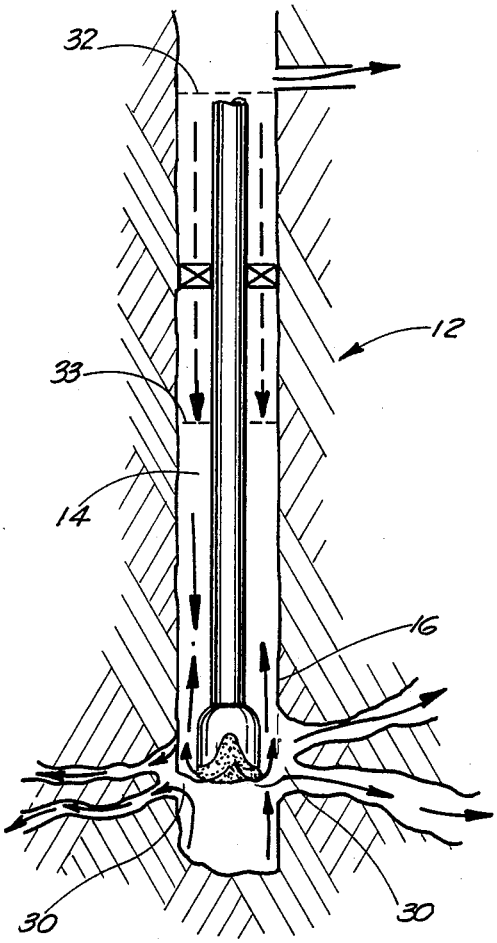
FIG. 2 illustrates in cross-section a borehole being drilled by a drill bit at the end of a drill string, wherein there is further illustrated a formation of a lost return zone down the borehole.

In FIG. 2, there is illustrated a problem which often arises in an open hole, during drilling, which is known as hitting a loss return zone. As illustrated in FIG. 2, again there is a typical borehole 12, however in this particular instance, a portion of the wall 16 of the open hole 14, has eroded at a lost return zone 30, and the mud which would normally fill the annulus between the drill string and the wall of the borehole has flowed into the formation at lost return zone 30, and therefore the level of mud which is normally at the return line 32 at the top of the hole has dropped a certain level 33 within the hole. Under this condition, when mud has entered a lost return zone, the mud will not circulate up back through the borehole, and one has completely lost all returns. Therefore, the drilling process must cease, and in most instances the hole must be plugged.

In the present state of the art, in most cases the only manner in which the recirculation can be reestablished in the hole is to attempt to locate the depth of the lost return zone 30, and if one is able to then to plug the erosion in the wall 16 with a series of plugging agents, or one may have to cement off that portion of the wall of the borehole in order to reconstitute the wall so that circulation may be resumed within the hole. In most cases, if the eroded wall cannot be plugged, the circulation is lost, and the drill string 20 must be pulled out of the hole and attempt to cement off the eroded area undertaken. This of course is a time consuming and very expensive undertaking, and presents a serious problem in the drilling of oil wells.

This represents the process of the present invention, wherein there is introduced a process for regaining circulation of mud after hitting a lost return zone. The first step in the process is to take into consideration that when one hits a lost return zone as seen in FIG. 2, certain quantity of mud within the annulus of the borehole has been lost and therefore the level of the mud has dropped a certain level. Therefore, the level of fluid within the borehole must be brought back to the surface. In the process, this is accomplished by introducing a lighter weight of fluid than the mud such as salt water, which is lighter in weight than the mud, and would be introduced into the annulus until such time as the level of the salt water would be brought to the level of the surface. At that point, one would close off the hydril in the borehole, so that where additional fluid introduced into the annulus, the same quantity of fluid could not spill over from the top of the annulus, in view of the fact that the hydril would be stopping any circulation out of the borehole. Next, one would introduce an additional quantity of salt water and the more salt water that is put into the hole, the more of the heavier mud is being pushed into the formation. However, this will not create a different hydrostatic head, but will maintain the same hydrostatic head.

Next, in the process, after the hydril is closed and water is forced into the hole, and for every barrel of mud that is pushed back into the formation there will be a quantity of pounds of pressure which will show up on a pressure gauge at the surface. However, the gauge is not indicating additional pressure on the formation. The gauge is indicating the difference of the lighter fluid in the annulus and the heavier mud being pushed out into the formation.

One must then calculate the amount of salt water that must be introduced into the hole in order to perfect the necessary equilibrium, so that recirculation can be achieved. In the oil field, there is known as a "ECD" or equivalent circulating density, which is anticipated at 0.3 pounds. This 0.3 pounds ECD is a factor which occurs at whatever depth the mud is. For example, at 1000 feet it may be 15.6 pounds, or at 10,000 feet it may be 156 pounds. Also, there is another 0.3 safety factor in the mud weight to be lowered in order to achieve recirculation.

For example, once the mud dropped and the annulus is filled with water, to lower hydrostatic head at any depth must lower to 0.3 pounds per ECD to be able to circulate and the safety factor must be lowered to circulate and not lose return by another 0.3 pounds. The 0.3 pounds is multiplied by a factor 0.052 (a constant that is used in the oilfield for working all of the hydrostatic head problems). X Depth=Hyd. Head).

The ability of drilling fluid to control subsurface pressure mainly depends on hydrostatic pressure. How much hydrostatic is exerted against the formation depends on mud density and the depth or height of the fluid column. Hydrostatic pressure can be calculated by the following equation:

Hydrostatic pressure (psi)=mud weight (#lb/gal)×dpth (feet)×Lb. Per Gal.×Depth T.V.D.×0.052=Hyd. Head This pressure is static pressure and only applies when the mud is not moving or circulating. If the mud is being circulated, additional pressure—that of annular—fluid friction—is also exerted against the formation. The magnitude of the pressure depends on the type of flow, properties of the fluid, and the geometry of the system.

In the present system following the drop of the mud in the annulus, and the loss of return up to the surface, this indicates that the mud has hit a lost circulation zone, and circulation has been lost. Therefore, the process of the present invention will enable the recovery of circulation in the annulus. When returns are lost, one cannot increase or decrease the pressure on any other formation in the hole. When the mud has dropped to a certain level, the first step in the process would be to fill up this air space back to the top of the surface usually with fresh water or salt water which is a lighter weight than mud. For example, if the hole created by the drop in the mud was 323 feet, it would take approximately 49.6 barrels of salt water to fill the annulus. 49.6 barrels of salt water represents 690 feet of annulus. However, this 690 feet of water would still maintain the same hydrostatic head. Following the filling of the annulus with he salt water, the next step in the process would be to close off the hydril so that additional water pumped into the annulus would not be pushed out of the upper portion of the annulus while the hydril is open. Following the closing of the hydril, pumping of water into the formation would pump additional mud into the lost return zone. Therefore, for every barrel of mud that is pushed into the formation, there will be so-many pounds of pressure which will show up on the mud pressure gauge. The mud pressure gauge however, is not reflecting the pressure on the formation. It is reflecting the difference of the "U" tube of a lighter fluid in the annulus and the heavier mud being pushed out. Therefore, when the hydril had been closed, the exact difference of the lower salt water weight, for example, 8.5 pounds and the weight of the 16 pound mud is the pressure that is reflected on the gauge. It is not a pressure on the formation it is only the difference of the two columns of mud. In order to determine the amount of water that must be placed into the annulus in order to regain circulation, the hydrostatic head must be lowered to 0.3 pounds per ECD (equivalent circulating density), to be able to circulate and some type of a safety factor must be lowered also to circulate and this is also an another 0.3 pounds. So the 0.3 pounds plus 0.3 pounds=0.6 pounds which is multiplied by the constant 0.052×Depth of lost return=Hyd.Head.

EXAMPLE FOR UTILIZING THE PROCESS OF THE PRESENT INVENTION

While drilling, one hits a loss return zone and the mud will not circulate in the hole. Normally one would wait for the hole to heal (8 to 24 hours). For example, if the depth of the hole was 13,000 utilizing 16 pound mud, the hydrostatic head would be 10,816 pounds. Further in the example, in the level of the mud is dropped 323 feet down in the annulus. Therefore, the loss in the hydrostatic head was 269 pounds. The volume in the hole was 13.91 linear feet per barrel of mud in a 5 inch drill pipe and 10¾inch casing. Therefore, the hole had a 935 barrel capacity. 5 inch drill pipe equals 56.30 linear feet per barrel that would equal to the 231 barrel capacity. If one were utilizing 16 pound mud, one would then introduce a lighter fluid such as 8.5 pounds of salt water. There would be a 7.5 pound difference between the 16 pound mud and the 8.5 pounds of salt water.

The next process in the step would be to fill the annulus with the lighter salt water until it stays full. Therefore, the loss in the hydrostatic head of 269 pounds divided by the constant of 0.052 and again divided by the 0.4 pound mud would equal the 13,000 feet T.V. depth.

The initial question to be asked is how many barrels of 8.5 pounds salt water it took to fill the annulus and stay full. After pouring the salt water down the hole, it would take 49.6 barrels of 8.5 pound salt water to fill the annulus and add the mud dropping 323 feet. Therefore, how far down will 16 pound mud be when the annulus is filled with 8.5 salt water.

Calculation: 49.6 barrels of salt water×13.91 linear feet/barrel=690 feet down in the annulus.

Next step is to find the loss of the hydrostatic head when the annulus is filled with 8.5 pounds of salt water.

Calculation: 690 feet×0.052 Constant×7.5 pounds (difference in mud weight and salt water weight)=269 pounds (loss in the hydrostatic head).

Next calculation would be to find the mud level of 16 pound mud dropped in the annulus when the returns were lost.

Calculation: 269 pound loss÷0.052 (Constant÷16 pound mud =323 feet down mud level. 16 pound mud dropped, how many barrels of 16 pound mud were lost in the formation?

Calculation: 323 feet down÷13.91 linear barrel=23 barrels of lost mud into the formation.

The next step would be to find the hydrostatic head and mud weight when the annulus is filled with 8.5 pounds of salt water. The weight of the hydrostatic head at 13,000 feet, T.V.D., 10,816 pounds minus 269 pounds loss equals 10,547 pounds new hydrostatic head.

Calculation: 10,547 pound hydrostatic head÷0.052 divided by 13,000 TPD=15.6 pound mud.

To lower hydrostatic head at any depth and there is a 0.3 pound ECD to be able to calculate and a safety factor which would also be a 0.3 pound, which must be lowered to circulate and not lose returns.

Calculation: 0.3 pound×0.052×13,000 T.V.D.=203 pounds per ECD. 0.3 pounds×0.052×13,000 T.V.D.=203 pounds for safety factor. 203 pounds+203 pounds =406 pounds hydrostatic head.

Note: This will be the casing engage pressure on the work sheet diagram.

The next step is to calculate the amount of 8.5 pounds salt water in the annulus that it would take to lower the hydrostatic head 0.3 pounds for ECD and 0.3 pounds for safety factor.

Calculation: 0.6 pounds×0.052×13,000=406 pound hydrostatic head. 406 pounds÷0.052 divided 7.5 pound difference=1040 feet of salt water. 1040 feet of salt water÷by 13.91 linear feet per barrel =74.8 barrels of salt water to pump down the annulus when the hydril is closed.

To find the mud weight and loss of hydrostatic head with 8.5 pounds salt water in the annulus. Calculation: 49.6 barrels to fill the annulus+74.8 barrels=124.4 barrels. 124.4 barrels salt water ×13.91 linear per barrels equals 1,730 feet of salt water.

Next calculation: 1,730 feet of salt water×0.052×7.5 pounds difference=675 pounds hydrostatic head.

Next calculation: 675 pounds hydrostatic head÷0.052 ÷13,000 feet=1.0 pound loss. 16 pound mud−1.0 pound loss=15.0 pound maximum mud weight to circulate with.

Next step would be to find the barrels of 8.5 pounds gel fresh/water to pump down the drill pipe in order to 3 pounds for safety factor.

Calculation: 0.6 pounds×0.052×13,000 TPD,=406 pounds hydrostatic head.

Next calculation: 406 pounds divided 0.052÷7.5 pound difference=1040 feet g/w. 1040 feet g/w ÷13.91 (linear feet per barrel)=74.8 barrels of gel water to pump down drill pipe with hydril closed, to lower hydrostatic head 406 pounds, would take 74.8 barrels of gel water.

Next step would be to find the barrels of mud and mud weight to pump down drill pipe on the top of the 74.8 barrels of gel water at 8.5 pounds to have a lighter mud weight while circulating out heavy mud with lighter fluid.

Calculation: 13,000 T.V.D minus 1040 for g/w=11960 feet.

Next Calculation: 11,960 feet÷13.91 linear feet per barrel=860 total barrels to pump down d.p. on top of 74.8 barrels of g/w. This would equal to 10,344 pounds.

Next Calculation: 10,816 (pound) hydrostatic head−269 pound loss=10,547 new hydrostatic head 10,5547 hydrostatic head−203 pounds for ECD = 10,344 pounds hydrostatic head 10,344 pounds hydrostatic head ÷ 0.052 and ÷ 13,000 = 15.3 pound mud that is needed to pump down d.p. on top of the 8.5 pound gel water to keep the mud weight less than leak off test on circulating bottoms up.

"Note" the amount of the 8.5 pound salt water pumped down annulus with the hydril closed must be pumped down the drill pipe also.

Figure 3:
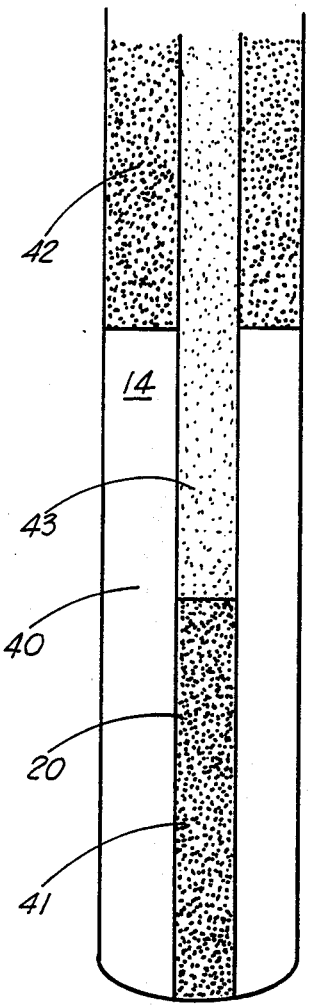
FIGS. 3–8 illustrate a representational cross-section view of the borehole and the steps in replacing the heavier mud in the borehole with lighter mud so as to reestablish circulation in the hole.

Having gone through the calculations in order to determine the amount of lighter weight mud that must be introduced into the borehole, in order obtain recirculation within the borehole, reference is made to FIG. 3, which illustrates, in representational view, the presence of the original 16 pound mud 40, contained within borehole 14 with the 8.5 pound gel water 41 having been introduced into the drill string 20, followed by the 15.3 pound mud 43 that has been calculated as the necessary mud weight in order to reestablish recirculation. It should be noted that the salt water 42 that had been originally introduced into the bore hole will now begin to be recirculated out of the bore hole as additional 15.3 pound mud is introduced into the string.

Figure 4:
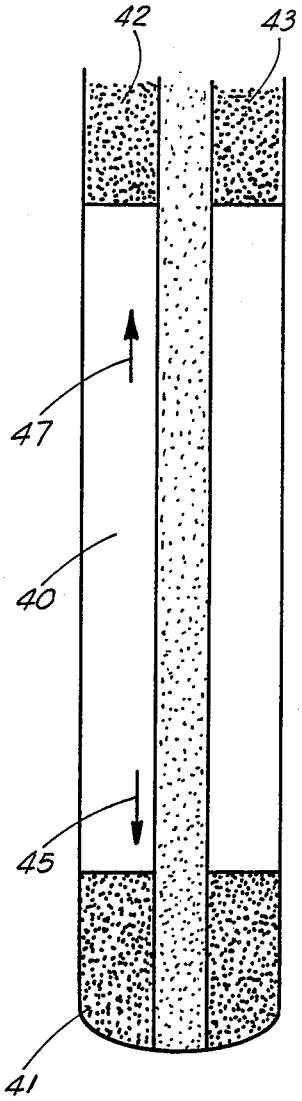

Turning now to FIG. 4, reference is made to the additional amount of 15.3 weight mud 43 being introduced further into the drill string in the direction of Arrow 45, wherein the salt water 42 is circulated out of the hole, and the 16 pound mud 40 is being moved upward in the direction of Arrow 47 out of the bore hole by the gel water 41 circulating down out of the drill bit and returning up to the annulus 40.

Figure 5:
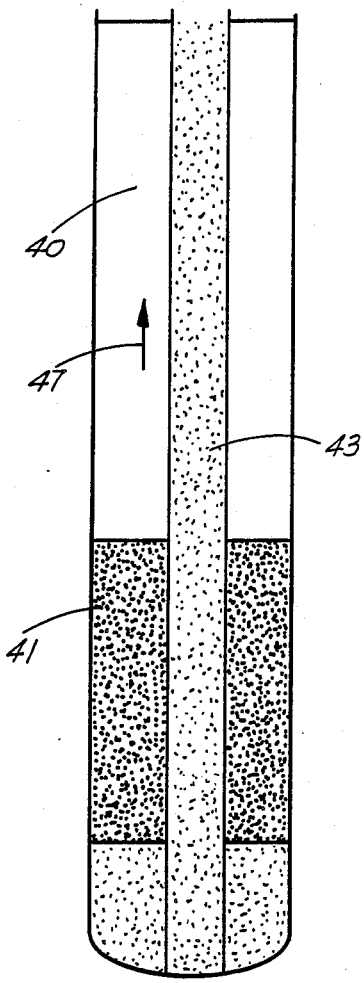

Turning now to FIG. 5, reference again is made to the fact that all of the salt water 42 has been recirculated out of the bore hole, and the 16 pound mud 40 is now being circulated out of the annulus in the direction of Arrow 47 moved upward by the gel water 41, which is being forced upward in the annulus from the 15.3 pound mud 43.

Figure 6:
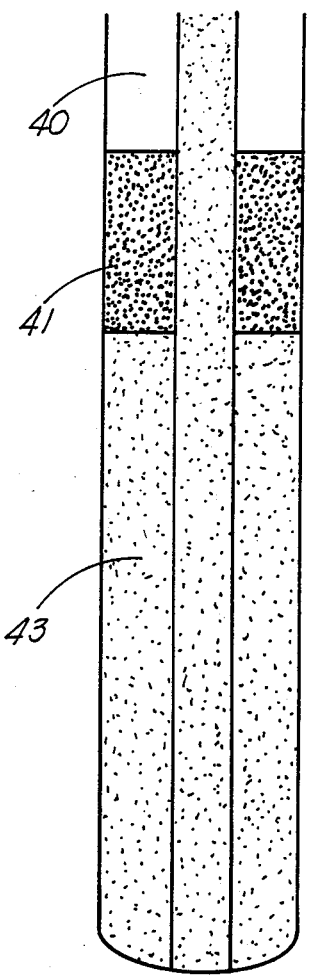

Turning now to FIG. 6, it is noted that the greater portion of the 16 pound mud 40 is now out of the annulus, and gel water 41 is moving upward to be flowed out of the annulus pushed by the continuing flow of 15.3 pound mud 43.

Figure 7:
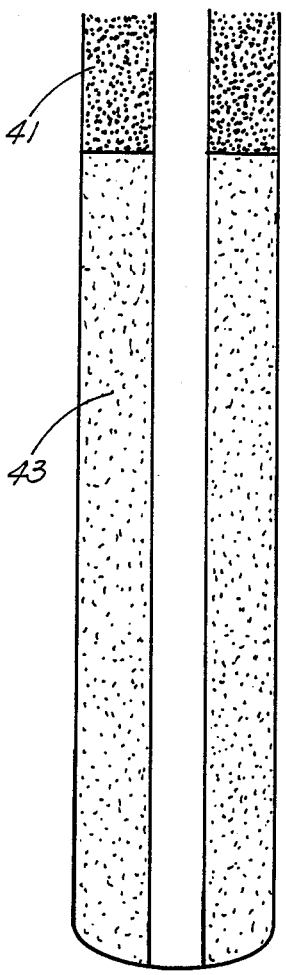

In FIG. 7 there is illustrated again all of the 16 pound mud 40 has been pushed out of the annulus, and the gel water 41 is ready to be circulated out of the annulus, with a greater portion of the annulus being filled with the 15.3 pound 43, and 15.0 mud will be circulated all the way around.

Figure 8:
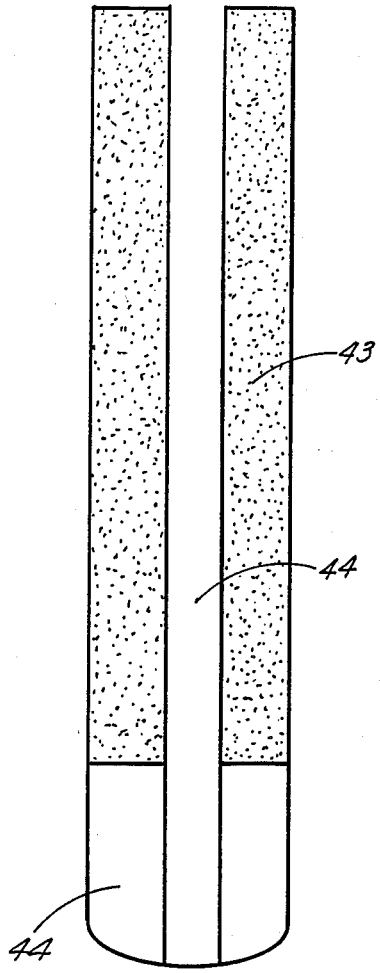

The final step in the process as illustrated in FIG. 8, the 15.3 pound mud 43 is pushed out at 15.04 contained solely within the bore hole, and therefore recirculation may be reestablished in view of the fact that the 15.0 pound mud calculated will be supported by the formation and will not be lost in the lost return zone.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A process for establishing recirculation down a borehole of drilling mud, following the collapse of the formation wall and the loss of mud into the formation to create a no return zone, the process comprising the following steps:

(a) establishing a drop of drilling mud within the annulus of the borehole, so that no drilling mud is returned to the surface during the drilling process;

(b) introducing a quantity of lighter weight fluid into the borehole, of such a reduced weight as to prevent further collapse of the formation wall, and in order to compensate for the drop of mud into the borehole, the fluid introduced substantially to the level of the surface of the borehole;

(c) closing off the upper end of the borehole, so that no fluid may flow out of the borehole;

(d) introducing additional lighter weight fluid into the borehole, so that the additional fluid will force the drilling mud into the loss return zone down the borehole;

(e) finding the pressure differential between the level of mud in the borehole in step (a), and the amount of fluid introduced into the borehole after the closing off of the borehole;

(f) calculating the weight of lighter weight fluid necessary to introduce into the borehole so as to enable the formation to hold the weight of the lighter weight fluid so that recirculation can be established within the borehole.

2. The process in claim 1, wherein the lighter weight of fluid introduced into the borehole to compensate for the drop of the mud is lighter weight salt water.

3. The process in claim 1, wherein the additional lighter weight fluid is forced into the borehole in order to drive the drilling mud into the lost return zone.

4. The process in claim 1, wherein the difference in the drop of the drilling mud and the level of the mud after it has been forced into the borehole is determined from a pressure gauge at the surface of the borehole.

5. The process in claim 1, wherein following the step of calculating the amount of lighter weight fluid that can be introduced into the borehole to reestablish circulation, introducing a quantity of lighter weight gel into the drill string.

6. Following the step in claim 5, opening the borehole so that the lighter weight gel may force the flow out of the borehole in the subsequent steps of the process.

7. Following the step in claim 5, introducing a quantity of lighter weight gel into the drill string inn order to force the heavier weight mud in the drill string back into the lost return zone.

8. Following the step in claim 5, introducing a calculated quantity of lighter weight drilling mud into the drill string, forcing the gel water out of the upper open end of the borehole.

9. Following the step in claim 5, introducing the lighter weight drilling mud into the borehole so that only the lighter weight drilling mud is contained within the borehole, and recirculation is thereby reestablished.

10. A process for establishing recirculation down a borehole, following the collapse of the formation wall due to the hydrostatic head weight, and the loss of mud into the formation to create the no return zone, the process for reestablishing circulation comprising the following steps:

(a) establishing a drop of drilling mud within the annulus of the borehole to a certain depth, so that no drilling mud is returning to the surface during the drilling process;

(b) introducing a quantity of fluid of a reduced weight to the level of the surface of the borehole so that collapse of the formation ceases;

(c) closing off the upper end of the borehole, so that no fluid may flow out of the borehole;

(d) introducing a quantity of additional lighter weight fluid into the borehole, to force the drilling mud into the no return zone down the borehole;

(e) calculating the pressure differential between the level of mud in the borehole instep (a), and the amount of lighter weight fluid introduced into the borehole after the closing off of the borehole; and (f) calculating the weight of lighter weight fluid necessary to introduce into the borehole so as to enable the formation to hold the weight of the mud so that

* * * * *